United States Patent [19]

Faldi

[11] 4,004,357

[45] Jan. 25, 1977

[54] TWO STROKE DREDGING PLANT

[76] Inventor: Giovanni Faldi, Via Forese Donati 27, Florence, Italy

[22] Filed: Mar. 13, 1973

[21] Appl. No.: 340,811

[30] Foreign Application Priority Data

Mar. 17, 1972 Italy ..... 22024/72

[52] U.S. Cl. ..... 37/58; 37/71

[51] Int. Cl.[2] ..... E02F 3/88

[58] Field of Search ..... 37/58, 59, 71, 65

[56] References Cited

UNITED STATES PATENTS

| | | | |
|---|---|---|---|
| 548,242 | 10/1895 | Wood et al. | 37/58 |
| 604,628 | 5/1898 | Mc Dougall | 37/58 |
| 645,660 | 3/1900 | Bell | 37/59 |
| 906,802 | 12/1908 | Horton | 37/58 |
| 1,691,686 | 11/1928 | Vorhies | 37/58 X |
| 2,337,818 | 12/1943 | Hill et al. | 37/58 |
| 2,933,837 | 4/1960 | Nelson | 37/65 |
| 3,600,832 | 8/1971 | Smith | 37/71 X |
| 3,624,933 | 12/1971 | Faldi | 37/71 X |
| 3,748,760 | 7/1973 | Schnell | 37/71 X |

FOREIGN PATENTS OR APPLICATIONS

| | | | |
|---|---|---|---|
| 164,846 | 10/1964 | U.S.S.R. | 37/58 |

*Primary Examiner*—Clifford D. Crowder
*Attorney, Agent, or Firm*—Karl W. Flocks

[57] ABSTRACT

A watercraft mounted pneumatically operated dredging plant comprising a dual shovel assembly in combination with a pumping unit, the shovel assembly including two shovels, each of which has a working edge facing in a direction opposite from that of the other, and the pumping unit having at least two pumping chambers for alternately connecting one of the shovels to a source of compressed air. The shovel assembly and pumping unit in assembly being adjustably suspended from the watercraft with respect to height and with the inclination of the working edge of each shovel with respect to the vertical being controllable to effect to-and-fro dredging strokes by the shovel assembly.

3 Claims, 9 Drawing Figures

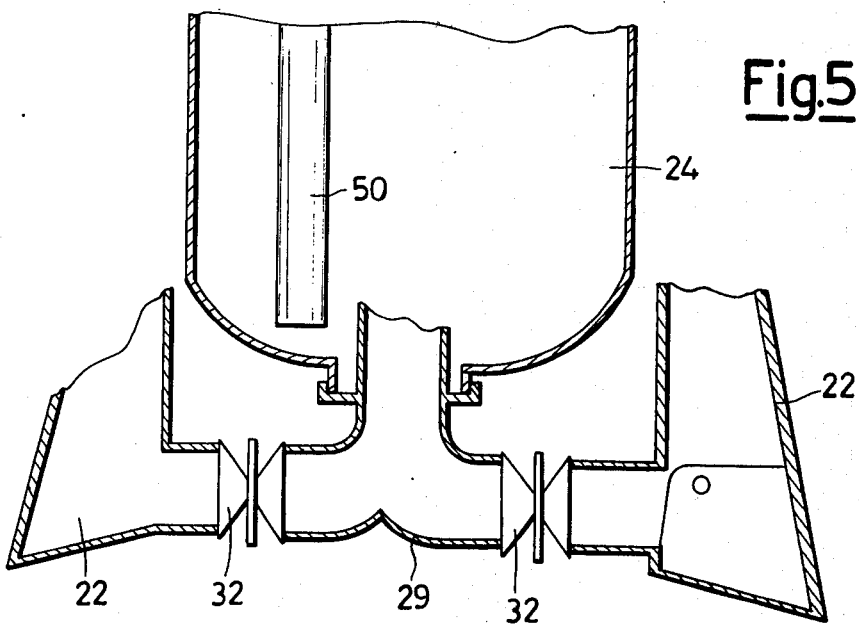
Fig.5
Fig.6
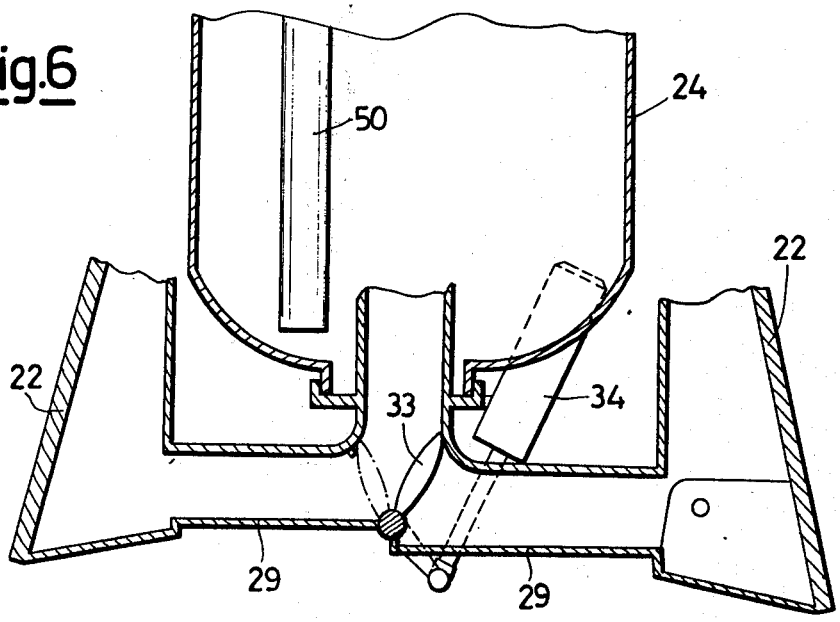

TWO STROKE DREDGING PLANT

This invention relates to a dredging plant mounted on a watercraft and operated by compressed air.

Dredging plants of this type are known and generally comprise a disintegrating and conveying shovel, the purpose of which is to engage with the bed to be dredged, removing material from it which mixed with water fills the chambers of a submerged pump body. These chambers are fed alternately with compressed air by which the dredged material is conveyed, for example through flow pipes, away from the dredging zone.

For the operation of these dredging plants, the watercraft is normally anchored to two fixed points, substantially aligned with the centre line of the watercraft, i.e. on the centre line from the bow to stern, and by means of towing members it is moved from one fixed point to the other, dragging the dredging shovel and the relative submerged pump body. Normally there is a working stroke, in which the dredging and sucking parts of the shovel, inclined to the vertical, face the direction of forward movement of the watercraft, and a return passive stroke in which the shovel is dragged, sliding over the path already dredged during the working stroke.

After the dredging strokes have been repeated a sufficient number of times, the two fixed anchoring points are moved parallel to said centre line and the operation is repeated in an identical manner.

It is obvious that the stated passive stroke substantially influences the time and cost of dredging.

On the other hand it has been found that dredging can be carried out only on relatively shallow beds if the disintegrating and conveying shovel is pushed in the direction of forward movement rather than dragged.

An attempt has been made to adopt double shovels facing opposite directions and arranged for alternate inclination with respect to the bed to be dredged. In effect, the attempted solutions in addition to being complicated and poorly functional, have been found unsatisfactory from the dredging point of view because where the control system for inclining the submerged shovel included a rigid arm firmly fixed to the watercraft, the dredging plant was useful only for shallow depths. Where the shovel was suspended from the watercraft by means of cables however, it was difficult to accurately control the inclination of the shovel to the bed to be dredged and hence the dredging efficiency. It should be explained that the term "adjustment of inclination of the shovels" means the adjustment of the angle of inclination of the working and cutting edge of the shovel to the bed which is dredged.

This adjustment of inclination of the shovels could be, at least theoretically, carried out by keeping the pump body vertical and varying the inclination of only the flat lower cutting part of the disintegrating shovel.

This control could be carried out by a compressed air or hydraulic piston, but it is evident that this form can be used practically only in the presence of fairly liquid mud and not of compact mud or hard clay, because in these cases the forces to which the shovel is subjected are such as to require the shovel to be formed in one piece with the pump body, in a particularly robust manner.

The present invention eliminates the problems and disadvantages briefly mentioned above, and consists of a dredging plant of the type comprising disintegrating and conveying shovel means associated with a submerged pumping body, comprising at least two pumping chambers arranged for alternate connection to the shovel means and to a source of compressed air, the assembly consisting of the pumping body and disintegrating shovel means being suspended adjustably in height from a watercraft arranged for anchoring to two fixed points between which it carries out the working stroke, characterised in that said disintegrating and conveying shovel means comprise two shovels with their working edges facing in opposite directions, that valve means are provided which can be stably changed over into one or other of two positions in which one or other of said two shovels is connected to said pumping body, and that the inclination to the vertical of each shovel is controlled by a cable whose axis intersects the centre line of the watercraft at a point external to the watercraft itself.

In a first preferred embodiment the watercraft is anchored to each of the two fixed points by a simple cable the second end of which is fixed to one drawing winch, and the other winch adjusts the depth to which the pumping-disintegrating shovel complex is submerged, the inclination of this latter being controlled by two inclination adjustment cables driven by corresponding winches, the two adjustment cables being engaged respectively, at the bow and stern of the watercraft, with corresponding rods or tubes immersed to a preset adjustable depth, by which the angle formed with the vertical by the submerged part of each cable for adjusting the inclination of the disintegrating shovels can be predetermined and adjusted, so as to ensure that the dragging action on the shovel by the watercraft takes place under the best possible conditions, and without interference with the bottom or edges of the watercraft or with the other cables.

In another equally important embodiment, the two drawing cables have a first end fixed to the drawing winches and the other end fixed to a winch for adjusting the inclination of the disintegrating and conveying shovels, the cable for adjusting the inclination of each shovel having one end fixed to the shovel itself and the other end fixed in an adjustable position to that section of drawing cable lying between the fixed anchoring point and said winch for adjusting the inclination of the shovels.

The particular aspects and advantages of the present invention will be more evident from the following description given by way of non-limiting example, with reference to the accompanying drawings in which:

FIGS. 5 and 6 are views analogous to FIG. 4 of modifications of the aforementioned changeover system;

Figure 1:
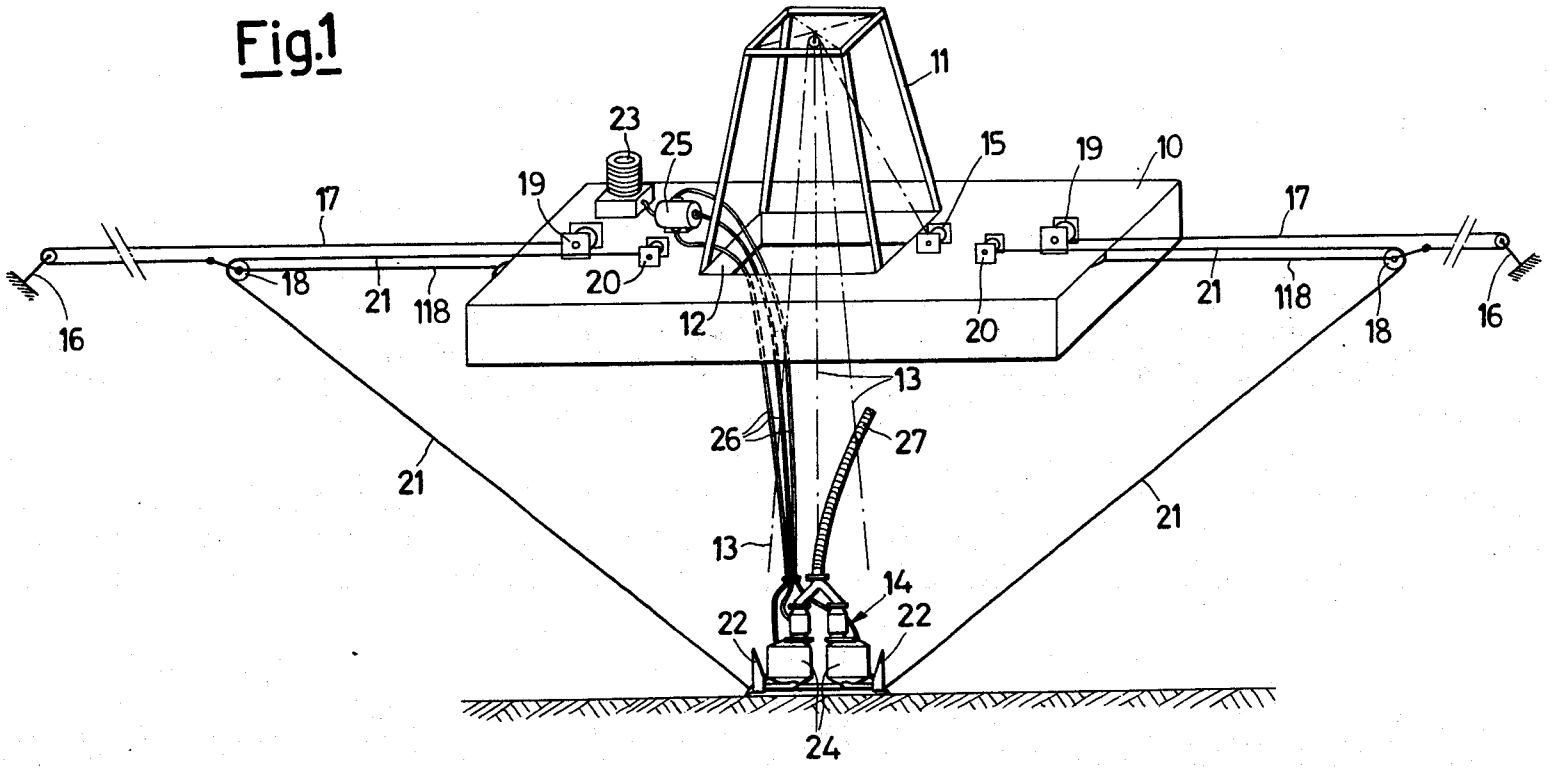
FIG. 1 is a diagrammatic simplified view of a first embodiment of the plant according to this invention.

FIG. 1 shows diagrammatically in its essential elements a first embodiment of the plant according to this invention, comprising a watercraft 10 at the centre of which there is a frame 11, formed in a position corresponding with a suitable aperture 12 in the centre of the watercraft and through which the cables 13 for supporting and adjusting the depth of immersion of the pumping unit dredging shovel complex 14, described in greater detail hereinafter. The cables 13, of which only the outlines are shown, are rigid in known manner with the pumping unit and are manoeuvred by the rising and lowering winch 15.

For operating the pumping unit 14, the watercraft carries a motor driven compressor 23 connected to the individual chambers 24 of the pumping unit by a distributor 25 (of known type) and flexible tubes 26. The pipe 27 serves for discharging the material to be pumped, this pipe (which in the drawing is broken at a certain point for simplicity) being able to discharge for example into a loading lighter, or constituting the upstream side of a conveyor system for conveying to a distance.

In order to carry out the dredging strokes the watercraft 10 is anchored to the fixed points shown by the anchors 16.

The watercraft 10 is connected to the anchorage points 16 by two cables 17, the end furthest from the watercraft of which is fixed to a pulley 18 (fixed to the watercraft 10 by a fixed cable 118), around which passes the cable 21 for adjusting the inclination of the dredging shovels 22. The winches 19 and 20 drag the watercraft by means of the cable 17 and adjust the inclination of the shovels by means of said cable 21, respectively. It is clear that in the dredging strokes, when one of the winches 19 is dragging, the other unwinds the relative cable 17 and vice versa. The winches 20 adjust the inclination of the shovels 22 by the cables 21. In this respect, particular attention should be given to the fact that as the connection points for the cables 21 are arranged according to the system described, the cables 21 exert a dragging action on the shovels 22 which otherwise would not be possible if the cables were merely vertical, and in this case would tend to raise the shovel carrying out the dredging action on the bed being dredged.

Figure 2:
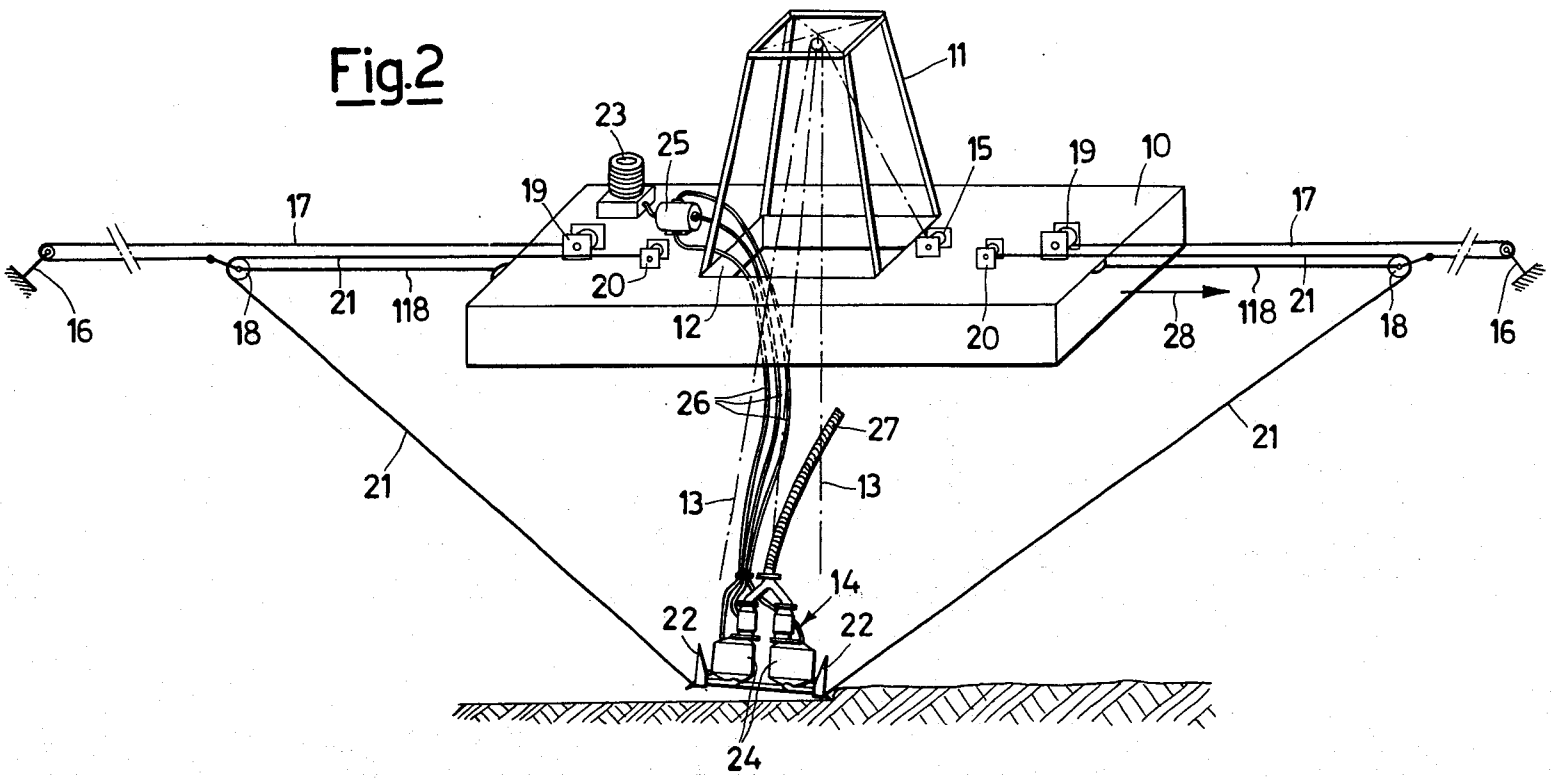
FIG. 2 is a view analogous to FIG. 1 of the plant in the working position.

As stated, FIG. 2 shows the same plant as FIG. 1 while in operation, namely while the watercraft is making a dredging stroke in the direction of the arrow 28.

Figure 4:
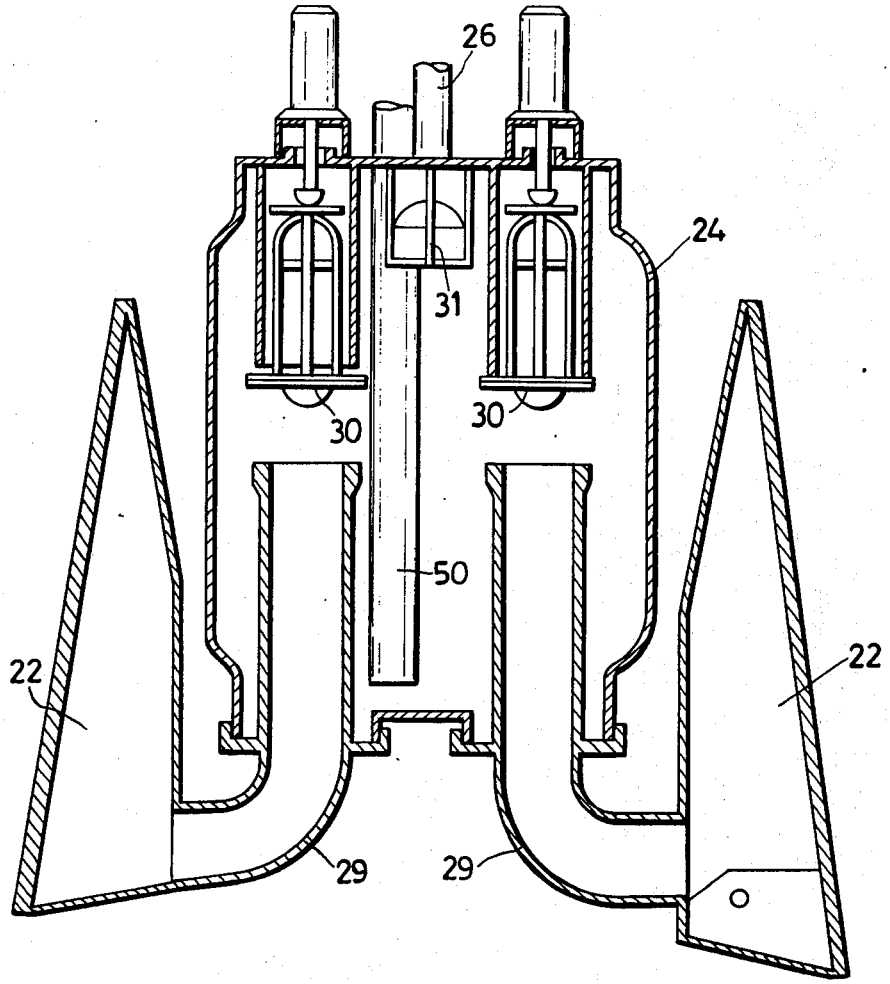
FIG. 4 is a detailed view of the relative changeover system between disintegrating and conveying shovels and the pumping body.

Reference will now be made to FIGS. 9 and 4 to 7, to illustrate in particular the pumping unit 14. In this unit the shovels 22, which oppose one another, are of a type well known in the art and described in previous patents of the same applicant, for example U.S. Pat. No. 3,624,933. Each shovel 22 is connected by pipes 29 to each pumping chamber or cylinder 24. The pneumatic pump body of two or more chambers operating alternately is also of known type. FIG. 4 shows clearly that each shovel 22 is connected to the cylinder 24 by the two tubes 29, which emerge on the inside of the cylinder 24 and can be closed by caps 30 controlled hydraulically or pneumatically, and the air under pressure for pumping enters the cylinder 24 through the valve 31 connected to the flexible feed pipe 26; the pipe 50 serves for discharging the dredged material and is connected to the outside by the pipe 27.

It is clear that during each dredging stroke of the watercraft 10, the mouth of the tube 29 relative to the shovel 22 which remains inactive and raised from the bed being dredged is closed by the corresponding cap 30, this disposition being reversed when the watercraft 10 makes its return stroke, which is also a dredging one.

In FIG. 5, the situation is substantially identical except that in the pipe 29 there are two gate valves 32, each downstream of their respective shovel 22, each valve 32 being for example controlled at a distance, pneumatically, or by a hydraulic system.

Finally in the embodiment shown in FIG. 6, in the pipe 29 there is inserted a flap valve 33 operated by a pneumatic or hydraulic cylinder 34, or operating with a counterweight.

Figure 3:
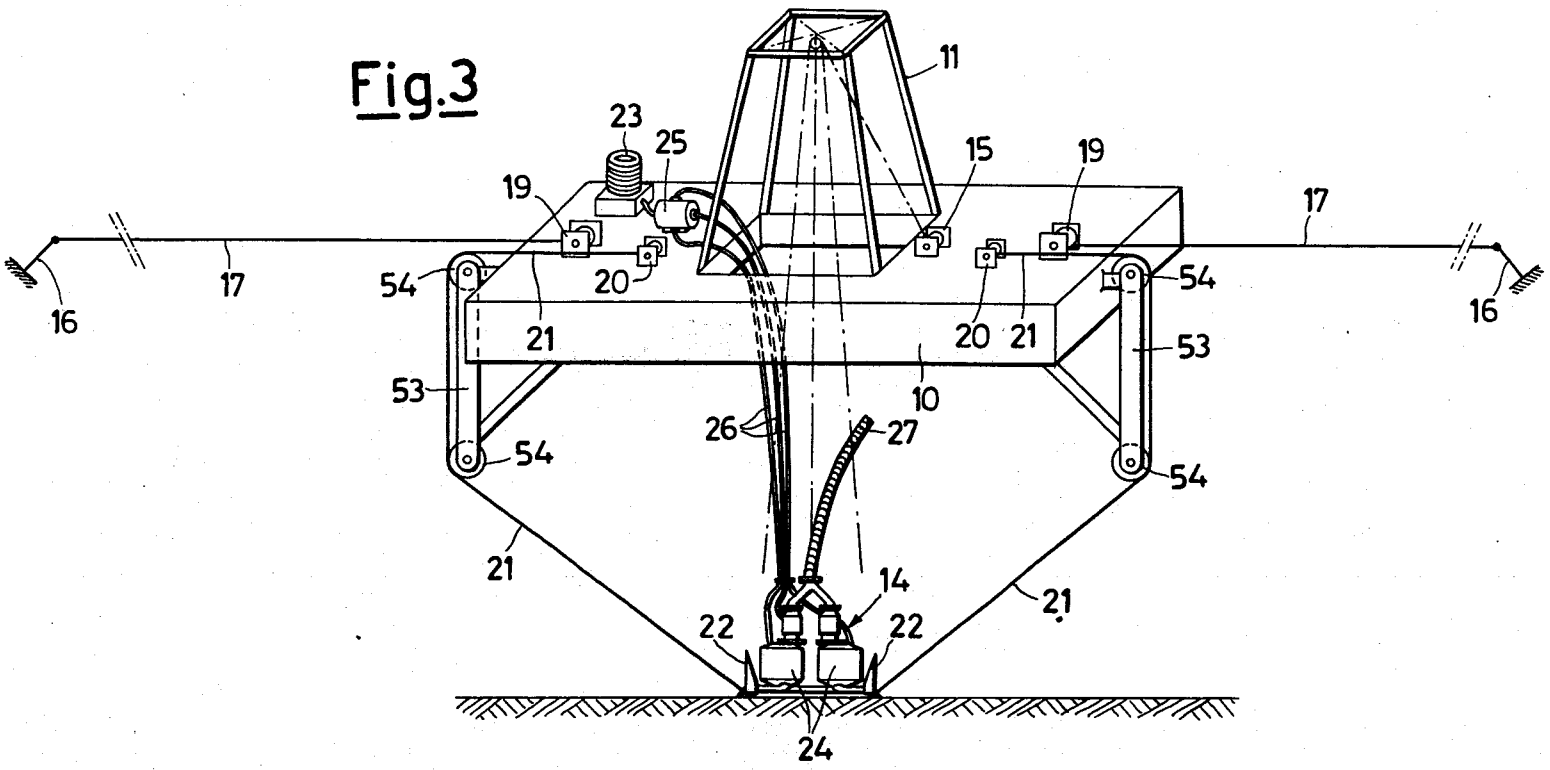
FIG. 3 is a view analogous to FIG. 1 of a further embodiment of the present invention.

In FIG. 3, in which parts corresponding to those of FIG. 1 are indicated by the same reference numerals, the required inclination of the cables 21 is obtained by means of two rods or bars 53 fixed in a suitable manner to the watercraft 10 and adjustable in height by simple means not shown, and are formed in pairs which enclose idle pulleys 54 around which the cables 21 pass. In this manner the same objects are attained as with the embodiment shown in FIG. 1.

Figure 7:
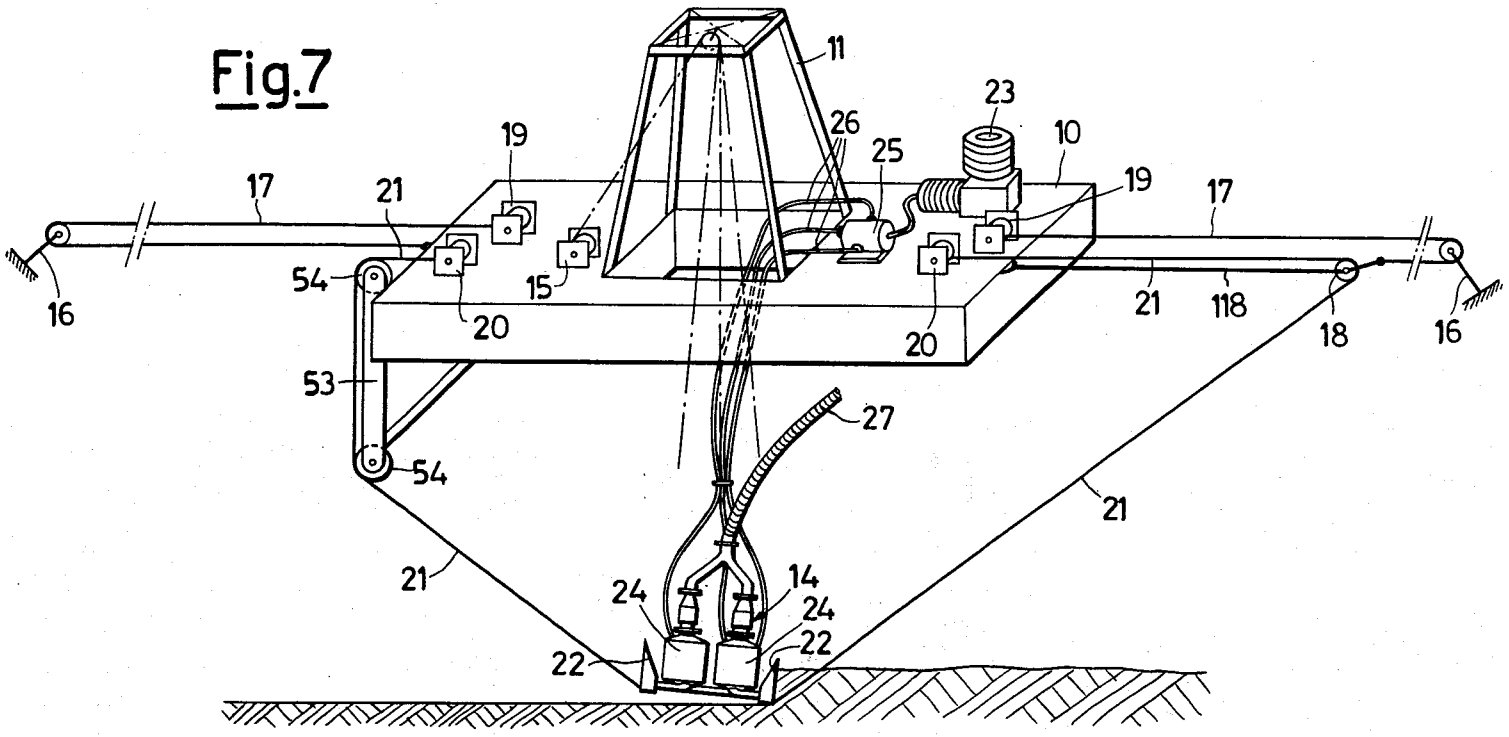
FIGS. 7 and 8 are views analogous to FIGS. 1–3 of other modifications of the invention.
Figure 9:
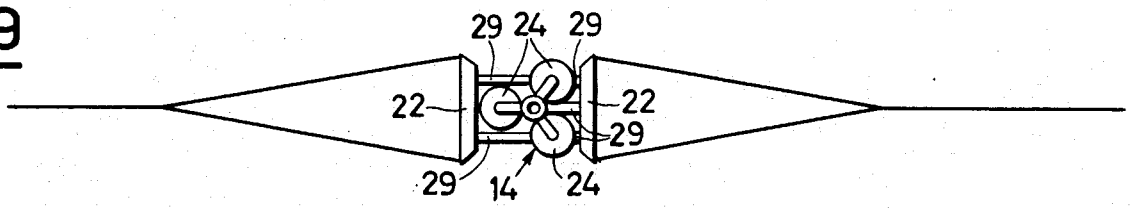
FIG. 9 is a diagrammatic plan view from above of the pump-dredging shovel unit.

FIG. 7 shows a further modification resulting from the combination of the systems of FIGS. 1 and 3, as is clear from the corresponding reference numerals applied to the various winches.

Figure 8:
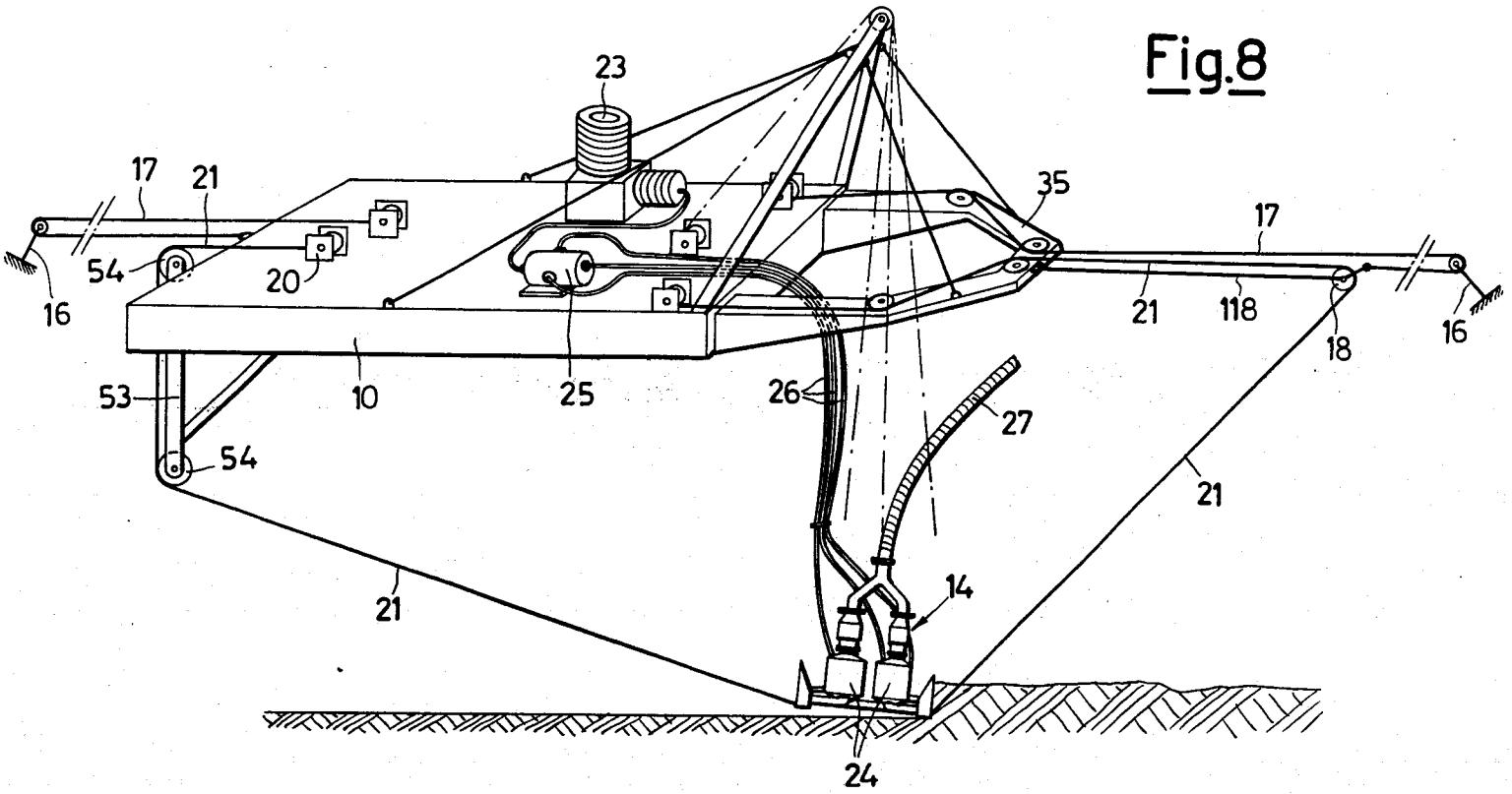

Finally FIG. 8 shows a further embodiment in which the watercraft 10 has a cable guide arm 35, in which the pump body passes.

From the preceding description it is clear that the present invention is based substantially on the fact that the cables for adjusting the inclination of the shovels, which also serve for dragging the submerged pump-dredging shovel unit, are inclined to the vertical by an angle which not only ensures precise adjustment of the inclination of the shovel concerned, but at the same time ensures maximum efficiency of dredging and engagement of the shovel with the bed to be dredged.

Furthermore, with the systems shown, the maximum capacity of the plant is maintained with regard to depth of dredging, because of the adjustability both of the immersed bar systems and those in which the point of connection of the cable 21 is external to the watercraft and aligned with its centre line.

It will be lastly useful to point out some features of the present invention.

In case a dredging is required, having a constant and predetermined depth in the bed to be dredged, the position of the pulley 18, as it is manifest, must be fixed, both as to distance from the watercraft and height from the bed.

To this end, if the pulley 18 is secured to the watercraft by means of a cable (such as that indicated by the reference 118), it will be necessary that the winch 19, from which the drawing cable is unwound during a dredging stroke, is suitably braked (in a manner per se known in the art), so as to induce in the other cable 17 being wound on the other winch 19 as well as in the corresponding cable 118 a proper level of tension and therefore of stretching.

As regards the height of the pulley 18 with respect to the bed being dredged, the pulley 18 can be either mounted on buoy or fastened, by means of two parallel, vertical links, to another idle pulley the cable 17 being in turn compelled to pass between the two links and within the race of the upper idle pulley, which is therefore supported by the cable 17 itself.

The aforesaid braking action is not applied in case some self-adjustment capability is required for the dredging plant, as a function of the characteristics of the bed being dredged. In fact, if the dragging resistance, as opposed by the bed to the dredging action, varies under a dredging stroke, the inclination of the dredging shovel will tend to increase or decrease as such a resistance does respectively decrease or increase, so as to accordingly restore the optimum conditions of stretching of the dragging and adjusting cables.

The dredging plant according to the present invention contemplates several embodiments which are conceptually equivalent to those already described and depending on particular field conditions.

Thus, in case the presence of attendants on board of the watercraft for the operation of the winches 19 is to be avoided, for instance when mined beds or basins having little extension and depth (and therefore light weight watercrafts are used) are to be dredged, the dragging winches 19 can be mounted on land at the two fixed points of anchorage of the watercraft, and as a consequence the dragging cables are single ones.

According to another embodiment, each cable 17 may have its first end secured to the respective winch 19 and the other end secured to the corresponding winch 20, while, at the same time, the pulleys 18 are replaced by corresponding clamping devices by which the cable 21 is fastened to the return course of the cable 17. In this way the operation of the winch 20 serves to vary and therefore to adjust the distance between the said clamping device and the watercraft, and thus the inclination of the dredging shovel.

According to a further embodiment, the cable 17 instead of having the second end secured to the watercraft from the fixed anchorage point 16 passes on the pulley 18 and therefrom to the shovel 22. In turn the pulley 18 connected to the winch 20 on the watercraft by means of another cable controlling the distance of the pulley 18 from the watercraft itself and therefore the inclination of the shovel.

Lastly, when the distance of the pulley 18 or of a clamping device securing the cable 21 to the cable 18 is to be kept constant or within a narrow range of adjustment, the cable 118 can be substituted by a rigid boom, protruding from the watercraft.

In the preceding description neither the pumping body nor the disintegrating and conveying shovels have been considered in detail, as they are well known to the art.

Furthermore, modifications and variations which are conceptually and mechanically equivalent may be made without leaving the scope of the invention.

What I claim is:

1. A dredging plant comprising in combination disintegrating and conveying shovel means and a submerged pumping unit connected thereto, said pumping unit having at least two pumping chambers, distributor means connected to said pumping chambers and thereby connecting said disintegrating and conveying shovel means to a source of compressed air via alternate ones of said pumping chambers, said pumping unit and disintegrating shovel means in assembly being adjustably suspended with respect to height from a watercraft which in operation is anchored to two fixed points between which working strokes are carried out, the said disintegrating and conveying shovel means further comprising two shovels each of which has a working edge facing in a direction opposite from that of the other, said disintegrating and conveying shovel means further having valve means which may be stably changed over to one of two positions whereby one or the other said two shovels is connected to said pumping unit, and a cable connected to each of said two shovels, said cable having an axis, starting from its connection with said shovels which intersects the center line of said watercraft at a point external to the watercraft itself and in operation controls the inclination of each of said shovels with respect to the vertical, said two fixed anchoring points being connected by dragging cables to drawing winches situated on the watercraft, said cables for adjusting the inclination of the shovels having one end adjustably fixed to a winch, and said adjustable connection between dragging cables and cables for adjusting the inclination further comprises a pulley secured to said watercraft at a fixed distance therefrom and fixed to the end of said dragging cable after this latter has passed around a pulley rigid with the fixed anchoring point, and the free end of an adjustment cable, passing around said pulley fixed to the end of said dragging cable, is fixed to said winch mounted on the watercraft, for adjusting the inclination of a shovel operatively associated therewith.

2. A dredging plant comprising in combination disintegrating and conveying shovel means and a submerged pumping unit, said pumping unit having at least two pumping chambers, distributor means connected to said pumping chambers and thereby connecting said disintegrating and conveying shovel means to a source of compressed air via alternate ones of said pumping chambers, said pumping unit and disintegrating shovel means in assembly being adjustably suspended with respect to height from a watercraft which in operation is anchored to only two fixed points between which working strokes are carried out, the said disintegrating and conveying shovel means further comprising two shovels each of which has a working edge facing in a direction opposite from that of the other, said disintegrating and conveying shovel means further having valve means which may be stably changed over to one of two positions whereby one or the other said two shovels is connected to said pumping unit, and cables connected to each of said two shovels, each of said cables having an axis, starting from its connection with said shovels which intersects the center line of said watercraft at a point external to the watercraft itself and in operation controls the inclination of each of said shovels with respect to the vertical, with each of said cables for adjusting the inclination of the shovels being fixed at their free end to a winch for adjusting the inclination mounted on the watercraft and, for the first section starting from the watercraft towards their respective shovel, being taut both at the bow and stern of the watercraft, with vertical rod or bar means immersed in the water to a variable depth.

3. A dredging plant as claimed in claim 2, in which each of said rod or bar means comprises, at its two ends, two idle pulleys in the races of which passes the respective cable for adjusting the inclination of the shovel operatively associated therewith.

* * * * *